US010151532B2

(12) United States Patent
Covizzi et al.

(10) Patent No.: US 10,151,532 B2
(45) Date of Patent: Dec. 11, 2018

(54) INDUSTRIAL TUNNEL OVENS

(71) Applicant: GEICO SPA, Cinisello Balsamo (IT)

(72) Inventors: Giampaolo Covizzi, Cinisello Balsamo (IT); Gianni Abbiati, Cinisello Balsamo (IT)

(73) Assignee: GEICO S.p.A., Cinisello Balsamo (MI) (IT)

( * ) Notice: Subject to any disclaimer, the term of this patent is extended or adjusted under 35 U.S.C. 154(b) by 0 days.

(21) Appl. No.: 14/653,765

(22) PCT Filed: Mar. 28, 2013

(86) PCT No.: PCT/IB2013/052507
§ 371 (c)(1),
(2) Date: Jun. 18, 2015

(87) PCT Pub. No.: WO2014/096981
PCT Pub. Date: Jun. 26, 2014

(65) Prior Publication Data

US 2015/0345867 A1 Dec. 3, 2015

(30) Foreign Application Priority Data

Dec. 21, 2012 (IT) ..... MI2012A2231

(51) Int. Cl.
*F27B 9/00* (2006.01)
*F27B 9/30* (2006.01)
*F27B 9/10* (2006.01)

(52) U.S. Cl.
CPC ..... *F27B 9/3005* (2013.01); *F27B 9/00* (2013.01); *F27B 9/10* (2013.01); *F27B 9/3011* (2013.01); *F26B 2210/12* (2013.01)

(58) Field of Classification Search
CPC ..... F26B 2210/12; F26B 3/283; F27B 9/00; B05D 7/14

(Continued)

(56) References Cited

U.S. PATENT DOCUMENTS 4,493,641 A * 1/1985 Hubbert ..... F26B 3/283 432/120
4,546,553 A * 10/1985 Best ..... F26B 21/00 118/642

(Continued)

FOREIGN PATENT DOCUMENTS

DE 3538122 C1 11/1986
EP 0911086 A1 4/1999

OTHER PUBLICATIONS

Italian Patent and Trademark Office Search Report for MI2012A002231 dated Aug. 5, 2013.

(Continued)

*Primary Examiner* — Gregory A Wilson
(74) *Attorney, Agent, or Firm* — MH2 Technology Law Group, LLP

(57) ABSTRACT

An industrial tunnel oven for heat treatment of parts may include: an outer wall that defines a tunnel; at least one inner wall; and a conveying line, at least partially inside the tunnel, configured to convey the parts along the tunnel. The outer wall may have a substantially cylindrical form above a base zone of the outer wall. The walls may define at least one interspace for hot air entering, leaving, or entering and leaving the oven. The at least one inner wall may extends along sides of the tunnel in an arc so as to define openings for the hot air to flow from the at least one interspace toward the conveying line, from the conveying line toward the at least one interspace, or from the at least one interspace toward the conveying line and from the conveying line toward the at least one interspace.

20 Claims, 7 Drawing Sheets

(58) Field of Classification Search
USPC ..... 432/143, 146, 147; 219/388; 34/266
See application file for complete search history.

(56) References Cited

U.S. PATENT DOCUMENTS

| | | | | | |
|---|---|---|---|---|---|
| 4,635,381 | A * | 1/1987 | Hubbert | F26B 3/283 | 34/225 |
| 4,733,481 | A * | 3/1988 | Hubbert | F26B 3/283 | 34/666 |
| 5,144,754 | A * | 9/1992 | Persson | F26B 21/06 | 34/233 |
| 5,588,830 | A * | 12/1996 | Josefsson | F26B 3/283 | 34/476 |
| 7,063,528 | B2 * | 6/2006 | Klobucar | F26B 21/10 | 34/266 |

OTHER PUBLICATIONS

International Search Report PCT/ISA/210 for International Application No. PCT/IB2013/052507 dated Aug. 14, 2013.
Written Opinion of the International Searching Authority PCT/ISA/237 for International Application No. PCT/IB2013/052507 dated Aug. 14, 2013.

* cited by examiner

INDUSTRIAL TUNNEL OVENS

CROSS-REFERENCE TO RELATED APPLICATION(S)

This application is a national stage entry from International Application No. PCT/IB2013/052507, filed on Mar. 28, 2013, in the Receiving Office of the International Bureau of the World Intellectual Property Organization ("WIPO") and published as International Publication No. WO 2014/096981 A1, which claims priority from Italian Patent Application No. MI2012A002231, filed on Dec. 21, 2012, in the Italian Patent and Trademark Office, the entire contents of both of which are incorporated herein by reference.

BACKGROUND

Field

The present invention relates to an industrial tunnel oven and, in particular, to a tunnel oven preferably for baking and/or drying paints on parts such as motor-vehicle bodies.

Description of Related Art

In industrial painting plants it is known to use tunnel ovens through which lines for conveying parts to undergo heat treatment pass.

These tunnel ovens usually have an internal chamber which is generally tubular and is heated by hot air passing through special blowing openings arranged on the inner walls of the tunnel. The tubular chamber is in turn contained inside a heat-insulating, parallelepiped shaped, external structure. All the components for conveying the hot air to the blowing openings and for subsequent recovery of the hot air from the tunnel for evacuation from the oven are situated between the tubular chamber and the external structure. Usually the space between the wall of the tubular chamber and the external insulating structure is therefore provided with various ducts and/or deflection baffles, unions, etc., for conveying the air. All these components must be firmly mounted on the structure and this involves the use of ribs, brackets and partitions arranged between the tunnel wall and the external structure. Circulation of the air is often disturbed by the irregular configuration of the circulation interspaces which are thus obtained and often further deflectors are required to prevent areas where stagnation or overheating occurs.

The known tunnel ovens therefore have a somewhat complex and costly structure. Moreover, the use of a plurality of metallic elements connected between the external structure and the wall of the tunnel creates heat bridges which must be thermally isolated from the outside of the oven in order to prevent excessive heat loss. This increases even further the complexity and the cost of the oven and in any case results in heat dispersion and an increase in the operating cost of the oven. The external parallelepiped-shaped form, with broad radiating surfaces, does not facilitate moreover heat insulation of the oven in relation to the exterior.

SUMMARY

The general object of the present invention is to provide a tunnel oven which is less complex and more efficient.

In view of this object the idea which has occurred according to the invention is to provide an industrial tunnel oven for the heat treatment of parts, such as motor-vehicle bodies and the like, comprising an outer wall inside which there is defined a tunnel allowing the passage of the parts from an inlet end to an opposite outlet end of the tunnel by means of a conveying line present along the tunnel, hot air being introduced inside the tunnel by means of hot-air inlet openings, characterized in that the outer wall has a substantially cylindrical form, except, where required, in a base zone, with an axis parallel to the direction of movement of the parts and that there is at least one inner wall which defines between itself and the outer wall at least one interspace for circulation of the hot air entering and/or leaving the tunnel.

In order to illustrate more clearly the innovative principles of the present invention and its advantages compared to the prior art, an example of embodiment applying these principles will be described below, with the aid of the accompanying drawings.

DRAWINGS

Figure 2:
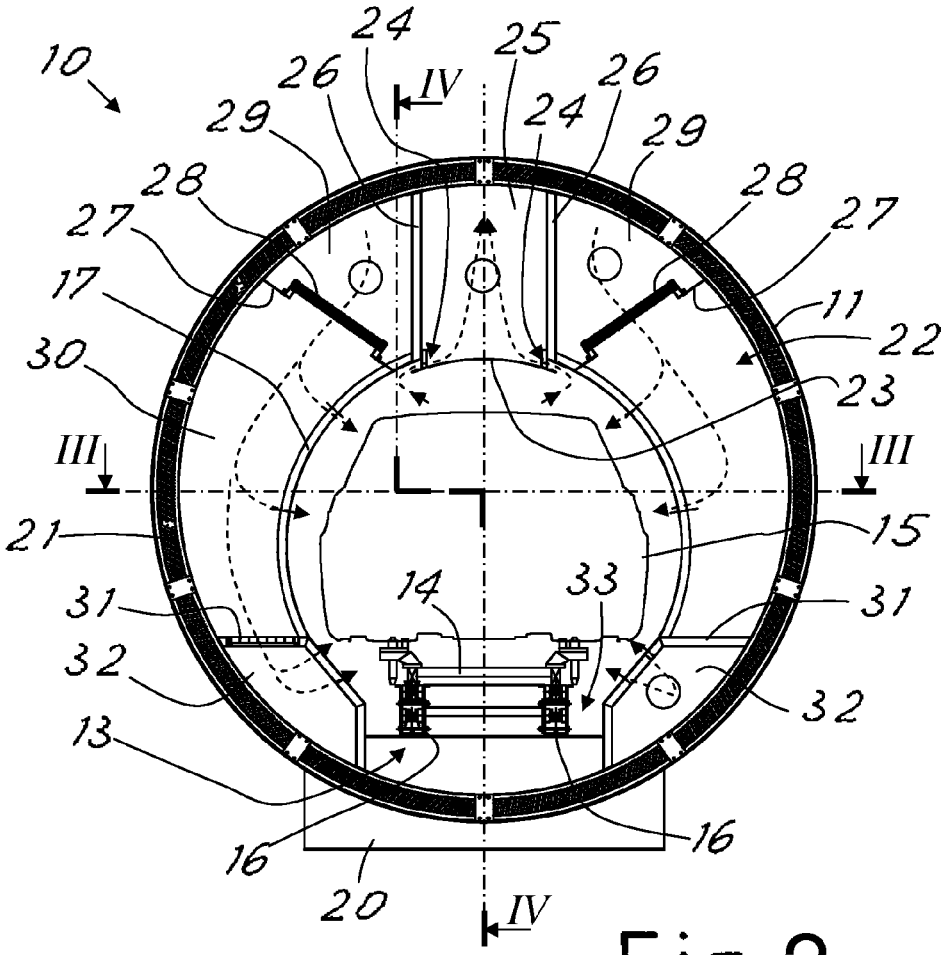
FIG. 2 shows a schematic cross-sectional view of the oven according to FIG. 1.
Figure 6A:
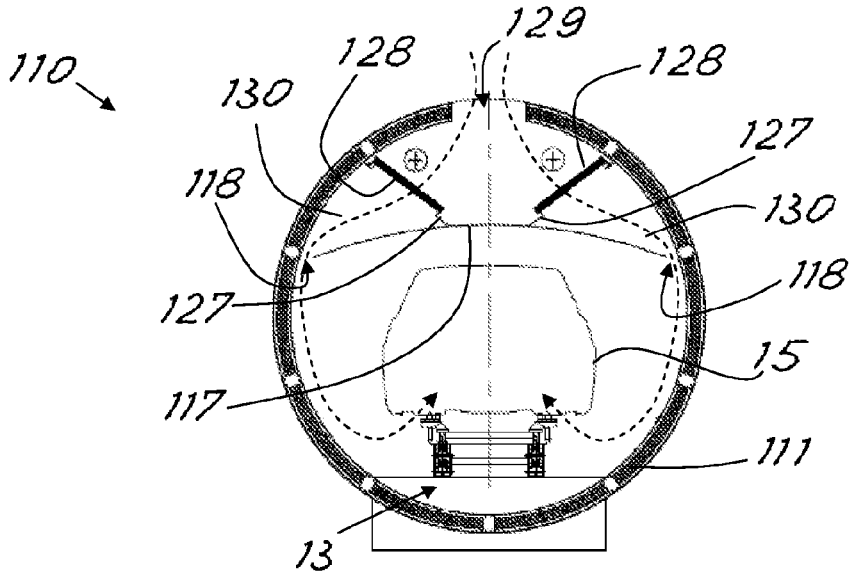
Figure 6B:
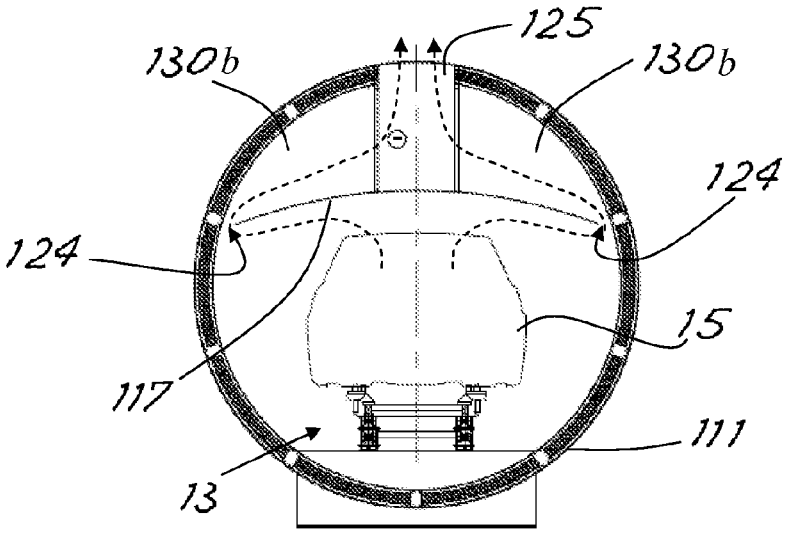
Figure 7A:
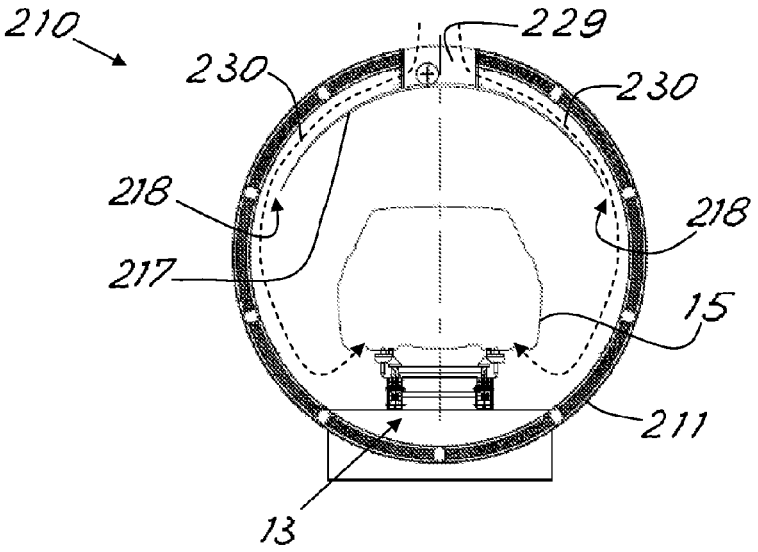
Figure 7B:
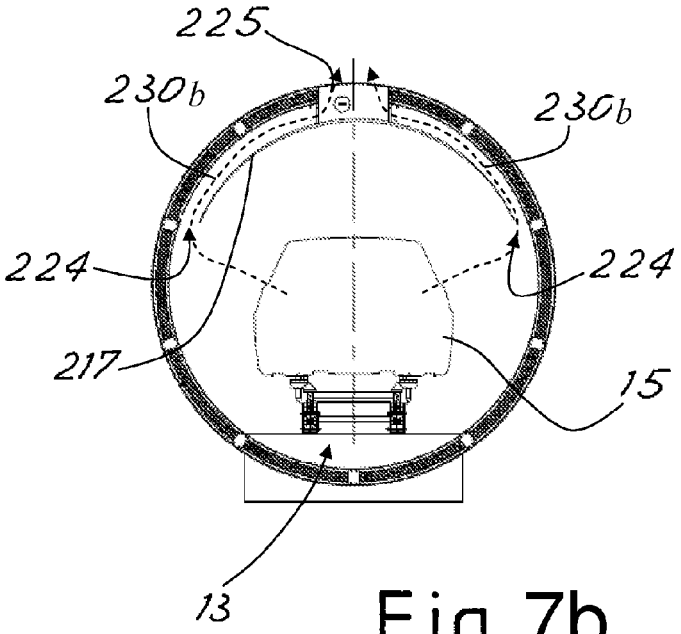
Figure 8:
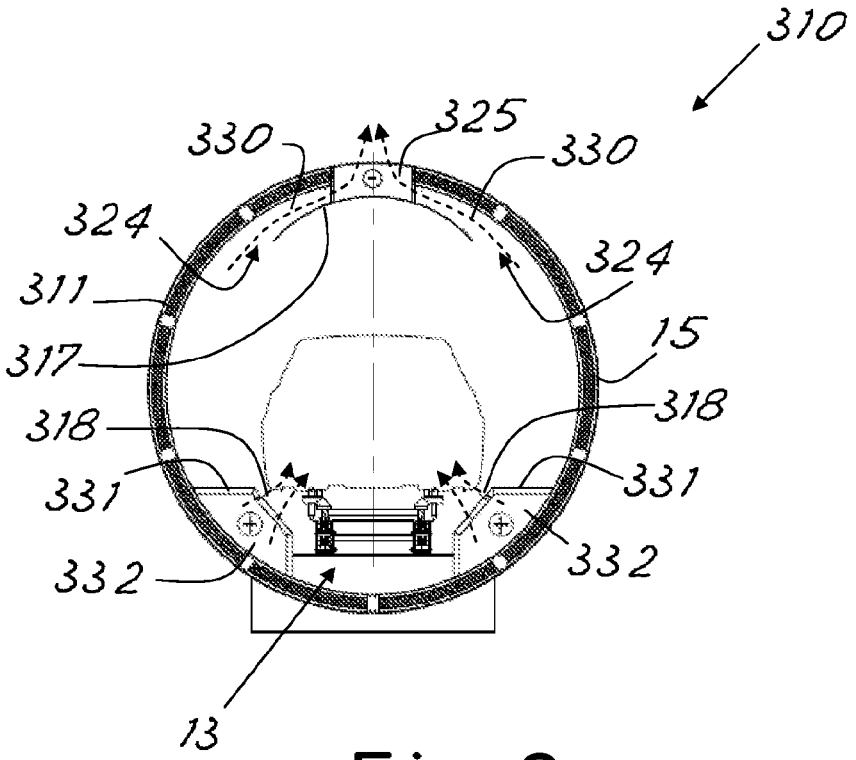
Figure 10:
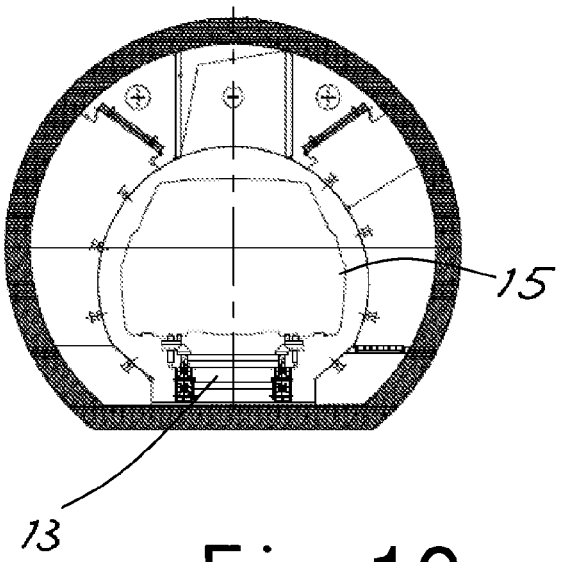
Figure 9:
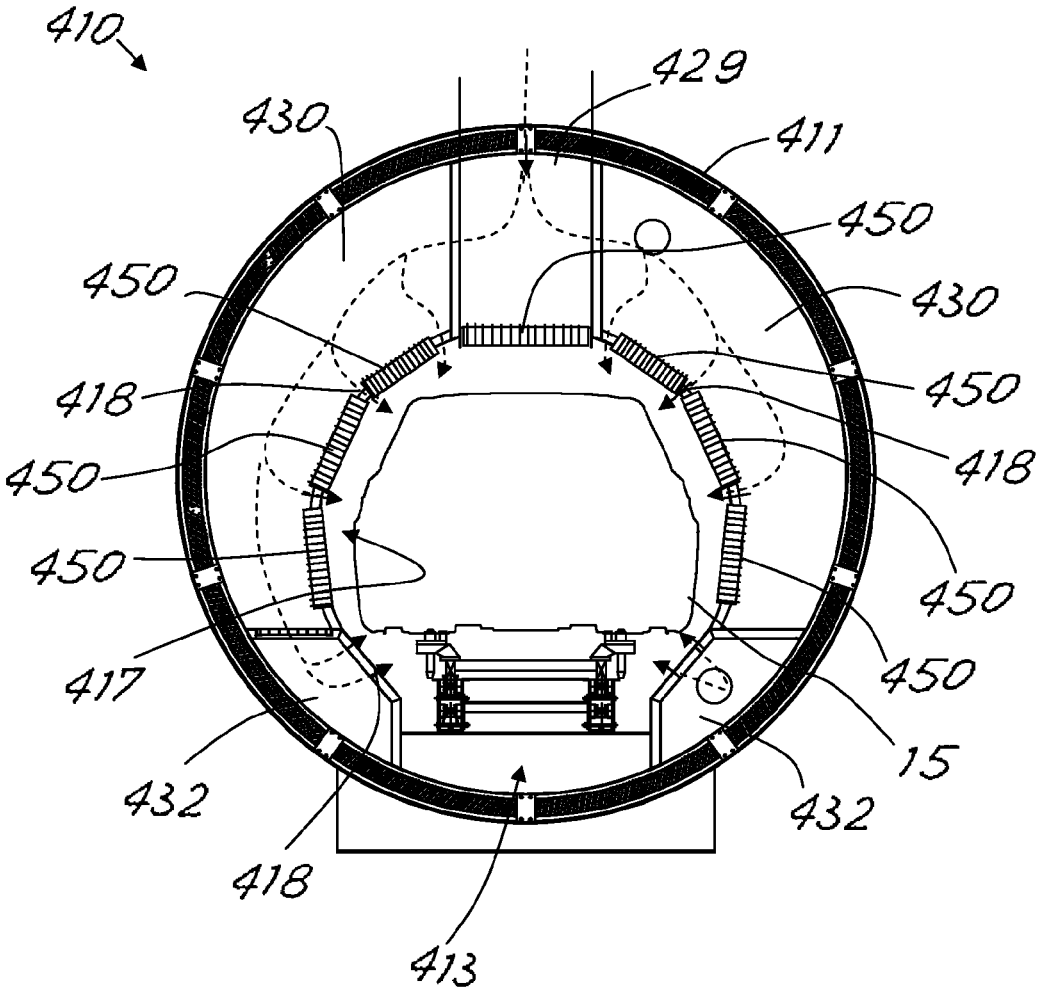

FIGS. 6*a* and 6*b* show two schematic cross-sectional views of a further embodiment of an oven according to the invention;

FIGS. 7*a* and 7*b* show two schematic cross-sectional views of another embodiment of an oven according to the invention;

FIG. 8 shows a schematic view similar to that of FIG. 2 and showing a further embodiment of the tunnel oven according to the invention;

FIG. 9 shows a constructional variant applicable to the various embodiments of the tunnel oven according to the invention;

FIG. 10 shows a further constructional variant applicable to the various embodiments of the tunnel oven according to the invention.

DETAILED DESCRIPTION

Figure 1:
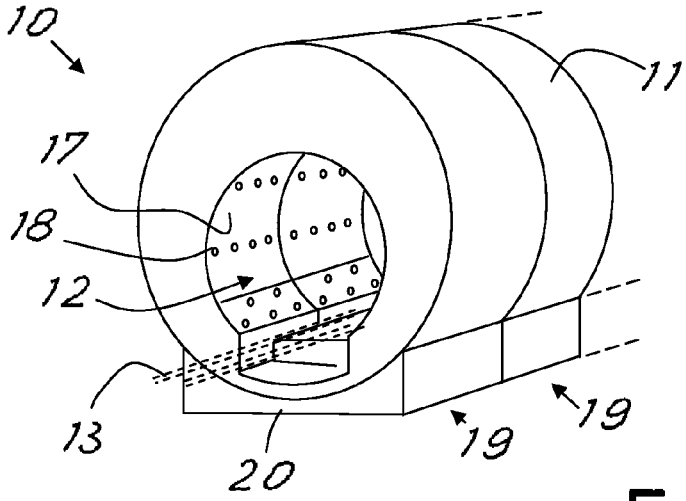
FIG. 1 shows a schematic partial perspective view of a tunnel oven according to the invention.

With reference to the Figures, FIG. 1 shows a tunnel oven according to the invention—denoted generally by 10—which comprises an external casing inside which there is defined a tunnel 12 through which the parts to be heated pass, moving between an inlet end and an opposite outlet end of the tunnel.

Advantageously, as will become clear below, the tunnel oven is composed of modular elements 19 which form tunnel segments and which are assembled by aligning them with each other in order to form a tunnel of the desired length depending on the specific heat-treatment requirements.

As shown by way of example also in FIG. 2 (which also shows the outline of a part to be treated 15 in the form of a motor-vehicle body), movement of the parts along the tunnel is advantageously performed by means of a known conveying line 13, for example a plurality of carriages 14, each supporting a part 15 and sliding along special rails 16 arranged on the tunnel floor.

The oven according to the embodiment of FIGS. 1 and 2 comprises an outer wall 11 and an inner wall 17. The inner wall extends at least along a cylinder arc and advantageously defines the tunnel 12 through which the parts to be treated 15 pass, said wall being provided with openings 18 (distributed over the surface) for the emission of hot air inside the tunnel.

The outer wall 11 and, preferably, also the inner wall 17, have a substantially cylindrical form (except, where required, in certain zones such as, advantageously, a base zone), with axes of the cylinders parallel to each other. In the embodiment according to FIG. 2 the walls 11 and 17 define between them at least one interspace 22 for circulation of the hot air towards the outlet openings 18 which are directly connected (through the wall 17) to the rear-lying zone of the interspace 22.

Advantageously, the cylindrical form of the inner wall 17 is interrupted at least in its bottom part (or floor zone) where a channel 33 containing conveying line 13 is present. Moreover, preferably the interspace 22 has a cross-section substantially in the form of a C with its arms directed downwards.

Again advantageously, as can be clearly seen in FIG. 2, the outer wall 11 forms a substantially complete cylindrical casing which has a horizontal axis and is provided with a support 20 for resting on the ground in the bottom zone. The outer wall is suitably insulated with a suitable lining of insulating material 21 so as to achieve the desired thermal insulation of the oven.

In the advantageous embodiment shown, the cylinder defined by the inner wall 17 is positioned offset downwards with respect to the cylinder defined by the outer wall 11. This therefore produces an interspace with a cross-section which is wider at the top of the oven and tapers downwards. Better guiding of the air towards the outlet openings is thus obtained.

Owing moreover to the preferred C-shaped form of the interspace, a supply of hot air in the two arms of the C (namely inside the interspace(s) 22 connected to the openings for emitting hot air inside the tunnel) is suitably conveyed towards the outlet openings without the need for further guiding elements or deflectors.

As can be clearly seen again in FIG. 2, at least one outlet 24 for the hot air is present on the tunnel arch. In particular, in order to form the air outlet, advantageously a panel 23 is present, said panel substantially continuing at the top the cylindrical wall of the tunnel, but (at least on the side edges) is slightly staggered downwards, so as to define side slits which form parallel outlets 24 along the length of the tunnel. For this purpose, the slits are in communication with an overlying interspace 25 for evacuating the hot air from inside the tunnel, which will be connected to a path for evacuation from the plant (not shown).

This interspace 25 is advantageously defined between tunnel arch and outer wall simply by means of two parallel and vertical baffles or partitions 26 arranged between inner wall 17 and outer wall 11 of the tunnel so as to separate an interspace zone 25 from the air inlet interspace 22.

The interspace 25 may extend along the whole length of the tunnel oven and be connected to external ducts (not shown) for evacuation of the hot air, arranged at the ends and/or in an intermediate position and/in several intermediate positions at intervals along the axial length of the oven.

Various baffles for dividing the interspace 22 into zones may be present between inner wall 17 and outer wall 11. If necessary, these baffles may comprise parts in the form of grilles and/or provided with filters for allowing the air to pass between the zones.

In particular, according to the embodiment of the oven shown in FIG. 2, the interspace 22 is advantageously divided into two zones in the vicinity of the oven arch (on the two sides of the interspace 25) by means of first baffles or top partitions 27 provided with suitable passages (advantageously with suitable filters 28) for passage of the air between a top zone 29 for entry of the hot air and an underlying zone 30 for conveying the air to the outlet openings 18. The baffles 27 are preferably two in number, being arranged symmetrically in each arm of the C.

Figure 4:
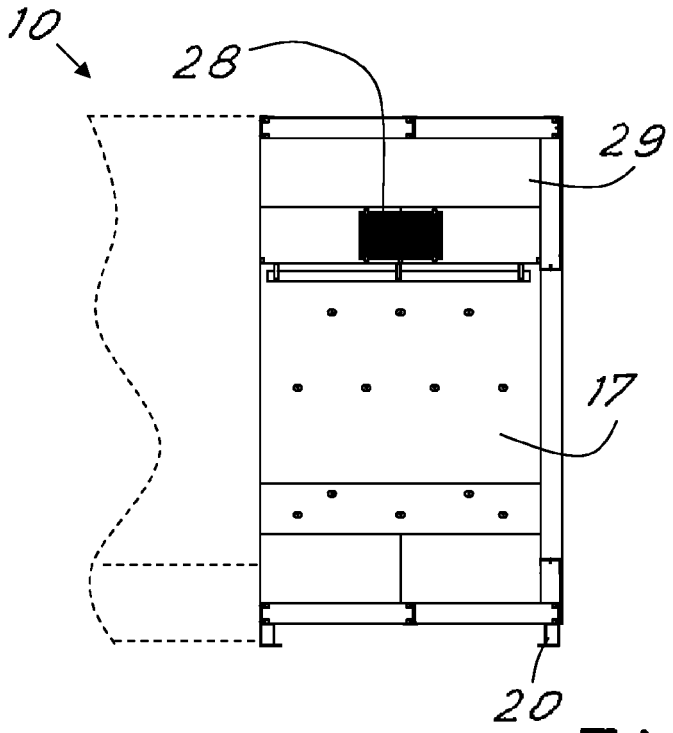
FIG. 4 shows a schematic cross-sectional view generally along the line IV-IV of FIG. 2.

The passages or filters 28 may be arranged at intervals along the baffle 27, as can be clearly seen in FIG. 4 for a module 19. If necessary, instead of or in addition to the filters 28, other elements such as, for example, air through-flow heaters, advantageously of the catalytic type, may also be used.

The two zones 29 may also be connected together, for example forming the interspace 25 with a limited length along the length of the tunnel. For example, this may also be achieved by forming several interspaces 25 at intervals along the tunnel, as may be easily imagined by the person skilled in the art.

In order to obtain an improved structural rigidity and also for the purposes which will be clarified below, it may be advantageous to provide a baffle or partition 31 arranged horizontal in the bottom part of the interspace 22. In particular, the bottom baffles 31 are two in number, each arranged inside a corresponding arm of the C-shaped interspace 22 so as to separate off from the interspace a bottom zone 32 which corresponds to the end part of the arm of the C.

Figure 3:
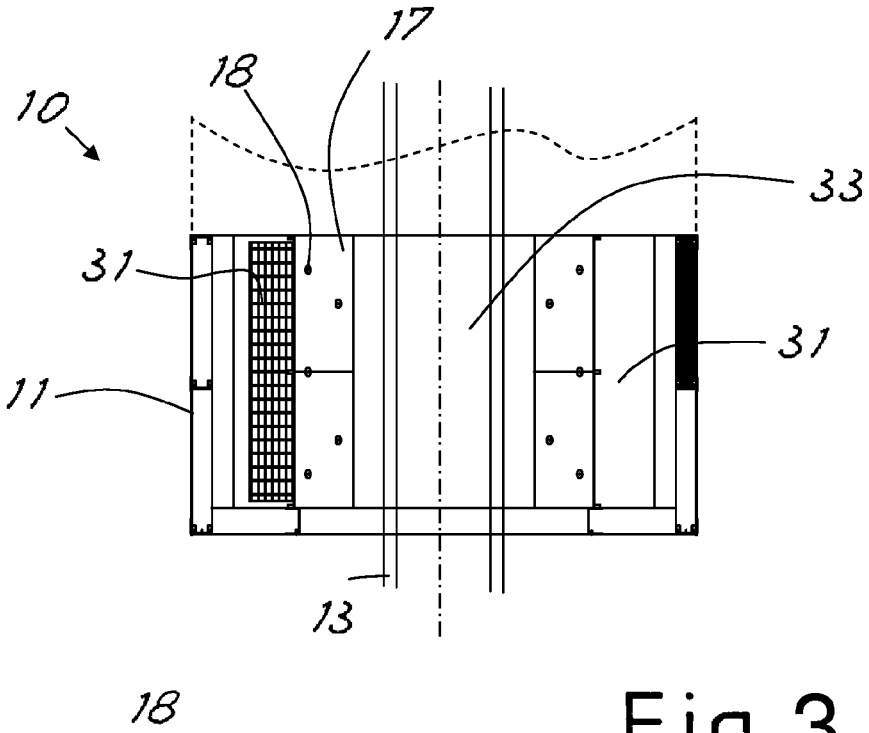
FIG. 3 shows a schematic cross-sectional view generally along the line III-III of FIG. 2.

The baffle 31 may be open (advantageously in the form of a grille), as shown on the left-hand side in FIG. 2 (and, more clearly, also in the top plan view of FIG. 3), so as to ensure continuous circulation of the hot air as far as the bottom end of the arms of the interspace 22, thus supplying also the lowest openings 18 which are connected to this zone.

Alternatively, the partition 31 may be closed (as shown on the right-hand side in FIGS. 2 and 3) so as to form a zone 32 which may be supplied with a separate flow of hot air introduced into the closed interspace thus formed.

In this way, if desired, separate flows of hot air may be supplied at a different temperature to the openings present in the side part of the tunnel and to the openings present in the bottom of the tunnel.

Figure 5:
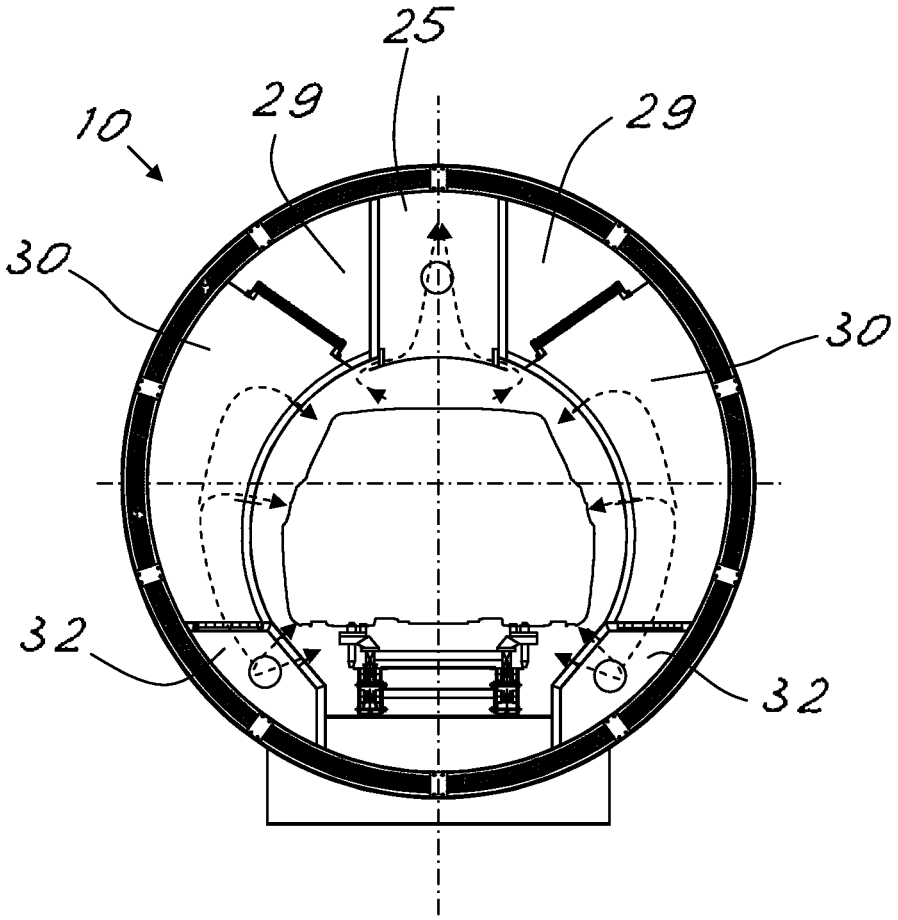
FIG. 5 shows a schematic view similar to that of FIG. 2 and showing a variant of the tunnel oven according to the invention.

FIG. 5 shows another alternative embodiment for circulation of the air in the oven, in which the hot air is supplied (on both sides) only through the bottom zones 32 and passes in the reverse direction through the grille partitions 31 in order to reach the side zones 30. In this case the top filters or passages 28 are inactive and may also not be present.

FIGS. 6*a* and 6*b* show a further alternative embodiment of the oven according to the invention. In particular, the two figures are transverse views, in two positions spaced along the axis of the tunnel and, advantageously, repeated at intervals, showing the alternating arrangement of zones for introducing hot air and zones for extracting hot air into/from the oven. The oven is preferably made in the form of modular segments, as is clear from the preceding embodiments.

In this tunnel oven, denoted generally by 110, there is an outer wall 111 which is generally cylindrical and insulated with a heat-insulating layer and inside which the conveying line 13 (similar to the conveying line 13 of the preceding embodiments) passes for conveying the parts 15 along the tunnel 12. Such a conveying line 13 is sometimes referred to as a travel way.

The oven comprises a cylindrical inner wall 117 extending along a cylinder arc and arranged close to the top arch of the tunnel so as to define between the walls a zone 129 for introducing hot air and an underlying zone 130 for conveying said air towards openings or slits 118 extending along the tunnel for the introduction of hot air into the tunnel. The air supplied via the inlet interspaces 129 passes through baffles 127 provided with openings on which filters 128 are preferably arranged, in a similar manner to the embodiment shown in FIG. 2.

The openings 118 are advantageously formed as slits defined by the end side edge of the wall 117 in the vicinity of the wall 111.

Owing to the curved wall 111, the air is directed towards the bottom of the tunnel so as to rise back up centrally, as schematically shown in FIG. 6*a*.

Sections, such as those shown in FIG. 6*b*, are alternated with the sections shown in FIG. 6*a*, the inner wall 117 thereof, along its edges close to the inner surface of the outer wall 111, forming side slits 124 which form parallel outlets along the length of the tunnel. These slits 124 are in communication with an overlying interspace 125 for evacuating the hot air from inside the tunnel, which will be connected to a path for evacuating the air from the plant (not shown). On the two sides of the overlying interspace 125 for evacuating the hot air from inside the tunnel, there are interspaces 130*b* which are advantageously separated by transverse baffles from the underlying zones 130 of FIG. 6*a*.

FIGS. 7*a* and 7*b* show another embodiment of an oven according to the invention. In particular, as for the preceding embodiment, the two figures are transverse views, in two positions spaced along the axis of the tunnel and repeated at intervals, showing the alternating arrangement of zones for introducing hot air and zones for extracting hot air into/from the oven. The oven is preferably made in the form of modular segments, as is clear from the preceding embodiments.

In this tunnel oven, denoted generally by 210, there is an outer wall 211 which is generally cylindrical and insulated with a heat-insulating layer and inside which the conveying line 13 (similar to the conveying line 13 of the preceding embodiments) passes for conveying the parts 15 along the tunnel 12. Such a conveying line 13 is sometimes referred to as a travel way.

The oven also comprises a cylindrical inner wall 217 extending along a cylinder arc and arranged close to the top arch of the tunnel so as to define between the walls a zone 229 for introducing hot air and an underlying zone 230 for conveying said air towards side openings or slits 218 extending along the tunnel for the introduction of hot air into the tunnel. Unlike the preceding embodiment, the filters have been omitted and the wall 217 is closer to and parallel to the outer wall.

The openings 218 are advantageously formed as simple slits defined by the end side edge of the wall 217.

Again owing to the curved wall 211, the air is directed towards the bottom of the tunnel so as to rise back up centrally, as schematically shown in FIG. 7*a*.

Sections, such as those shown in FIG. 7*b*, are alternated with the sections shown in FIG. 7*a*, the inner wall 217 thereof, along its side edges, forming side slits 224 which form parallel outlets along the length of the tunnel. These slits 224 are in communication with an overlying interspace 225 for evacuating the hot air from inside the tunnel, which will be connected to a path for evacuating the air from the plant (not shown). On the two sides of the overlying interspace 225 for evacuating the hot air from inside the tunnel, there are interspaces 230*b* which are advantageously separated by transverse baffles from the underlying zones 230 of FIG. 7*a*.

Both in this embodiment and in the preceding embodiment, if conveying to the outlet via the interspaces 130*b* and 230*b* is not required, the evacuation interspace 125 and 225 may be connected to the tunnel arch by means of a central screen part, in a similar manner to the panel 23 in FIG. 2. In this case, the blowing slits 118 and 218 may also extend along the whole tunnel and transverse baffles for separating the underlying zones 130, interspaces 130*b*, underlying zones 230, and interspaces 230*b* will not be required.

FIG. 8 shows a further embodiment of a tunnel oven according to the invention, denoted generally by 310. In this embodiment, two box-shaped ducts 332, arranged along the sides of the conveying line 13 conveying the parts 15, are present at the bottom inside the space defined by the insulated cylindrical outer wall 311. These ducts 332 (formed by the outer wall 311 and by the baffles 331) are supplied with hot air (via a source not shown) so as to emit air into the tunnel through the openings 318.

An inner wall 317, which is advantageously cylindrical and extends along a cylinder arc, is also present in the vicinity of the tunnel arch, said wall defining interspaces 330 between the outer wall 311 and the inner wall 317 for evacuation of the hot air through the side slits 324 and a central interspace 325.

FIG. 9 shows another further constructional variant which can be applied also to the other various other solutions described here. This variant, which is denoted generally by 410, has a structure which may be substantially similar to one of those of the preceding embodiments. A structure similar to the embodiment of FIG. 2, with a few differences as regards circulation of the air, is shown by way of example. For the sake of simplicity, parts which are similar to those of the oven 10 are indicated substantially by the same numbering increased by 400.

According to this variant 410, the inner wall 417 comprises or is formed by a plurality of radiating elements or panels 450 (known per se and consisting of one type from among various types well known to the person skilled in the art, for example, electrical, gas, catalytic, or other type) for heating the inside of the tunnel. The openings 418 for emitting hot air are advantageously arranged between the heaters. An alternative arrangement could, however, also be envisaged, such that the heaters are passed through by the air, if considered desirable. In this case, the air could also reach a temperature lower than the oven heating temperature.

Basically, with the variant 410 both irradiation and convection heating of the parts 15 conveyed along the tunnel by the conveying line 413 is achieved.

The incoming air circulation is shown in FIG. 9 as being in the centre of the oven arch, with a central duct 429 which supplies the two lateral interspaces 430 formed between the outer wall 411 and the inner wall 417. The evacuation of the air (not visible in FIG. 9) may be performed for example alternating with the ducts 429 along the longitudinal extension of the tunnel, as described for some of the preceding embodiments. In this way heaters may also be provided on the arch of the tunnel, as shown in FIG. 9, in order to obtain more uniform irradiation. Circulation of the incoming/outgoing air may in any case also be performed as already described for the other embodiments.

As already described for the other embodiments, further bottom openings 418 may be supplied via bottom interspace zones 432, which are turn supplied by the same top air flow (as shown on the left-hand side in FIG. 9) or also by a separate flow (as shown on the right-hand side in FIG. 9). Radiating elements 450 (not shown) may also be provided on the wall 417 in these bottom zones. At this point it is clear how the predefined objects have been achieved. The structure of the oven is thus greatly simplified, essentially being composed of an outer structure and an inner structure which are substantially cylindrical with few baffles and interspaces.

Circulation of the hot air is facilitated without the need for complex ducts or internal conveying deflectors, the heat insulation is facilitated and, if required, there exist various possibilities for circulating the air depending on the specific requirements of the plant, with rapid or simple modifications. The radiating surface is also optimized with respect to the internal volume.

As may be now easily appreciated by the person skilled in the art, with an oven structure according to the invention it is easy to provide modular segments or modules 19 which, being arranged next to each other and connected by means of fastening systems (for example bolts and flanges), allow the rapid construction of ovens of varying lengths, it being required to merely join together the inner walls, outer walls and transverse baffles of adjacent modules.

Each module may also have an end provided with a wall for closing the edges of the cylindrical walls, provided with through-holes for connecting the corresponding interspaces to the next module in the row. Moreover, a module with an end wall closed between the edges of the cylindrical walls (as shown in FIG. 1) may also be provided at the two ends of the tunnel.

Obviously, the above description of an embodiment applying the innovative principles of the present invention is provided by way of example of these innovative principles and must therefore not be regarded as limiting the scope of the rights claimed herein. For example, the conveying system may be different from that described and shown. Moreover, the dimensions and proportions of the various parts may vary depending on the specific requirements. For example, FIGS. 2 and 5 show a car body as the part to be treated and the tunnel is correspondingly designed to house this body, but it is understood that the measurements may vary in the case of other parts. The walls may also be formed by segments which are more or less rectilinear so as to approximate a cylindrical, surface. If required, part of the solutions shown in some of the embodiments described may also be used in the other embodiments described, as may be now easily imagined by the person skilled in the art.

It is understood that, although for the sake of simplicity reference has been made to cylindrical walls, "cylindrical walls" are understood here as also meaning walls formed by segments which are more or less rectilinear so as to approximate a cylindrical surface.

As shown by way of example in FIG. 10 and applicable to all the embodiments of the tunnel oven described, the outer wall may also be formed flattened in the bottom zone which rests on the ground and supports the conveying line, so as to reduce further the complexity of the structure.

The invention claimed is:

1. An industrial tunnel oven for heat treatment of parts, the oven comprising:

an outer wall having upper, lower, and side portions; and at least one inner wall inside the outer wall;

wherein the outer wall and the at least one inner wall define a tunnel, at least one interspace separate from the tunnel, and openings, wherein the tunnel is defined between the at least one inner wall at a top of the tunnel, the side portions of the outer wall at sides of the tunnel, and the lower portions of the outer wall at a bottom of the tunnel, wherein the at least one interspace is defined between the at least one inner wall and the upper portions of the outer wall, wherein the openings are slits defined between the outer wall and end side edges of the at least one inner wall, wherein the tunnel is configured to allow passage of the parts from an inlet end of the tunnel to an outlet end of the tunnel via a conveying line along the tunnel, wherein the outer wall has a substantially cylindrical form, above a base zone of the outer wall, with an axis parallel to a direction of movement of the parts, wherein the at least one interspace is configured to allow circulation of hot air entering the tunnel, leaving the tunnel, or entering and leaving the tunnel, wherein the openings are configured to introduce the hot air directly from the at least one interspace into the tunnel, to evacuate the hot air directly from the tunnel into the at least one interspace, or to introduce the hot air directly from the at least one interspace into the tunnel and to evacuate the hot air directly from the tunnel into the at least one interspace, and wherein the openings extend along the tunnel.

2. The oven of claim 1, wherein the at least one inner wall extends along sides of the tunnel in an arc.

3. The oven of claim 1, wherein the at least one inner wall has a substantially cylindrical form which is interrupted in a bottom part of the substantially cylindrical form so as to define a channel in which the conveying line is present.

4. The oven of claim 1, wherein the at least one interspace has a substantially C-shaped cross-section with downwardly directed arms.

5. The oven of claim 1, further comprising:

baffles between the upper portions of the outer wall and the at least one inner wall;

wherein the baffles are configured to divide the at least one interspace into zones.

6. The oven of claim 5, wherein the baffles comprise filters, grilles, or filters and grilles configured to pass the hot air between the zones.

7. The oven of claim 5, wherein the baffles comprise at least top baffles which define at least one first top zone in the at least one interspace in a vicinity of an arch of the tunnel and act as inlets for the hot air.

8. The oven of claim 7, wherein the top baffles are two in number, and wherein the top baffles are each arranged inside a corresponding arm of the at least one interspace so as to be passed through by a flow of the hot air directed toward outlet openings of the corresponding arm of the at least one interspace.

9. The oven of claim 1, wherein ducts are present along sides of the conveying line, and wherein the ducts receive a flow of the hot air directed toward the openings configured to introduce the hot air into the tunnel.

10. The oven of claim 1, further comprising:

modular segments which are assembled so as to ensure continuity of corresponding tunnel sections, the at least one interspace, the outer wall, and the at least one inner wall of each modular segment.

11. The oven of claim 1, wherein the outer wall comprises a heat-insulating layer.

12. The oven of claim 1, wherein the outer wall also has the substantially cylindrical form in the base zone of the outer wall.

13. An industrial tunnel oven for heat treatment of parts, the oven comprising:

an outer wall having upper, lower, and side portions; and at least one inner wall inside the outer wall;

wherein the outer wall and the at least one inner wall define a tunnel, at least one interspace separate from the tunnel, and openings, wherein the tunnel is defined between the at least one inner wall and the lower and side portions of the outer wall, wherein the at least one interspace is defined between the at least one inner wall and the upper portions of the outer wall, wherein the openings are slits defined between the outer wall and end side edges of the at least one inner wall, configured to route hot air along the outer wall between the outer wall and the end side edges of the at least one inner wall, wherein the tunnel is configured to allow passage of the parts from an inlet end of the tunnel to an outlet end of the tunnel via a conveying line along the tunnel, wherein the outer wall has a substantially cylindrical form, above a base zone of the outer wall, with an axis parallel to a direction of movement of the parts, wherein the at least one interspace is configured to allow circulation of the hot air entering the tunnel, leaving the tunnel, or entering and leaving the tunnel, wherein the openings are further configured to introduce the hot air directly from the at least one interspace into the tunnel, to evacuate the hot air directly from the tunnel into the at least one interspace, or to introduce the hot air directly from the at least one interspace into the tunnel and to evacuate the hot air directly from the tunnel into the at least one interspace, and wherein the openings extend along the tunnel.

14. The oven of claim 13, wherein the outer wall also has the substantially cylindrical form in the base zone of the outer wall.

15. The oven of claim 13, further comprising:

baffles between the upper portions of the outer wall and the at least one inner wall;

wherein the baffles are configured to divide the at least one interspace into zones.

16. The oven of claim 15, wherein the baffles comprise filters, grilles, or filters and grilles configured to pass the hot air between the zones.

17. An industrial tunnel oven for heat treatment of parts, the oven comprising:

an outer wall having upper, lower, and side portions; and at least one inner wall inside the outer wall;

wherein the outer wall and the at least one inner wall define a tunnel, at least one interspace separate from the tunnel, and openings, wherein the tunnel is defined between the at least one inner wall and the lower and side portions of the outer wall, wherein the at least one interspace is defined between the at least one inner wall and the upper portions of the outer wall, wherein the openings are slits defined between the outer wall and end side edges of the at least one inner wall, wherein the tunnel is configured to allow passage of the parts from an inlet end of the tunnel to an outlet end of the tunnel via a conveying line along the tunnel, wherein the outer wall has a substantially cylindrical form, above a base zone of the outer wall, with an axis parallel to a direction of movement of the parts, wherein the at least one interspace is configured to allow circulation of hot air entering the tunnel, leaving the tunnel, or entering and leaving the tunnel, wherein the openings are configured to introduce the hot air directly from the at least one interspace into the tunnel along the outer wall, to evacuate the hot air directly from the tunnel into the at least one interspace along the outer wall, or to introduce the hot air directly from the at least one interspace into the tunnel along the outer wall and to evacuate the hot air directly from the tunnel into the at least one interspace along the outer wall, and wherein the openings extend along the tunnel.

18. The oven of claim 17, wherein the outer wall also has the substantially cylindrical form in the base zone of the outer wall.

19. The oven of claim 17, further comprising:

baffles between the upper portions of the outer wall and the at least one inner wall;

wherein the baffles are configured to divide the at least one interspace into zones.

20. The oven of claim 19, wherein the baffles comprise filters, grilles, or filters and grilles configured to pass the hot air between the zones.

* * * * *